US005550884A

United States Patent [19]

Berney

[11] Patent Number: 5,550,884

[45] Date of Patent: Aug. 27, 1996

[54] "GOLF COUNTER" DEVICE AND WATCH COMBINED WITH SUCH A DEVICE

[76] Inventor: Jean-Claude Berney, Route de Mouthe, CH-1343, Les Charbonnières, Switzerland

[21] Appl. No.: 325,342

[22] PCT Filed: Mar. 16, 1993

[86] PCT No.: PCT/CH93/00072

§ 371 Date: Oct. 28, 1994

§ 102(e) Date: Oct. 28, 1994

[87] PCT Pub. No.: WO94/21338

PCT Pub. Date: Sep. 29, 1994

[51] Int. Cl.[6] ..... A63B 71/06

[52] U.S. Cl. ..... 377/5

[58] Field of Search ..... 377/5

[56] References Cited

U.S. PATENT DOCUMENTS

| | | | |
|---|---|---|---|
| 4,142,236 | 2/1979 | Martz et al. | 364/411 |
| 4,523,857 | 6/1985 | Ushikoshi | 368/157 |
| 4,864,592 | 9/1989 | Lee | 377/5 |
| 5,127,044 | 6/1992 | Bonito et al. | 377/5 |

FOREIGN PATENT DOCUMENTS

| | | |
|---|---|---|
| 3816713 | 11/1989 | Germany . |
| 2126383 | 3/1984 | United Kingdom . |
| 9003204 | 4/1990 | WIPO . |

*Primary Examiner*—Margaret Rose Wambach

*Attorney, Agent, or Firm*—Griffin, Butler, Whisenhunt & Kurtossy

[57] ABSTRACT

An analogue display golf counter comprises a first example four hands independent of each other driven by four stepping motors. The position of the hands is controlled by an electronic system comprising counting, storing, processing and control means in response to programmed algorithms and to data introduced by means of two pushers. The first hand indicates the course position (hole), the second the operating mode, and the last two the number of points, one displaying the units with the sign and the other the tens. There are three operating modes, namely "simple total", "cumulative total" and "programming". In this latter mode, it is possible to program a standard course to which reference may be made.

15 Claims, 6 Drawing Sheets

COUNTER
M SC
ADDER CIRCUIT
P1
STORING CIRCUIT
MP
MC
COUNTER
M SC
ADDER CIRCUIT
P2
STORING CIRCUIT
MP
SHAPING CIRCUIT
+/−
P1
P2
BUS
STORING CIRCUIT
MP
P HAND
MC
ADDER CIRCUIT
P HAND
SHAPING CIRCUIT
P START
PROCESSING CIRCUIT
CONTROL CIRCUIT
CONTROL CIRCUIT
55
56
45
46
42
43
44
47
62
63
69
83
41
57
58
59
61
60
64
65
66
70
68
71
72
67
48
52
49
7
54
53
50
51
8

"GOLF COUNTER" DEVICE AND WATCH COMBINED WITH SUCH A DEVICE

FIELD ON THE INVENTION

The present invention concerns an analogue display "golf counter" device and a watch, for example of the wristwatch type, combined with such a device.

BACKGROUND OF THE INVENTION

Small golf counters which enable simply a player's strokes at a hole to be counted, without the possibility of providing a cumulative total, nor the possibility of taking account of the par, are already known. The means of obtaining the complete result of a round of golf is relatively complex. For each hole, there is a par. If the player uses less strokes than the par for that hole, he scores points and his score is negative; if he uses more strokes he loses points and his score is positive. The scores at each hole are then added together. If at the end of the round, the player has a negative score, he has done better than the total par for each hole. If his score is positive, he has done worse. His final result is then obtained after deduction of his handicap, this handicap taking account of the difference in level between the various players. Further, it is advantageous to have a clear view of the game at any time, and to have the possibility of knowing the "simple total" corresponding to the score of the play in progress, and the "cumulative total" corresponding to the cumulative score since the beginning of the game.

SUMMARY OF THE INVENTION

A purpose of the present invention is to provide a golf counter enabling account to be taken of all the peculiarities of the game of golf and providing simple reading as with analogue display means.

The invention thus concerns an analogue display golf counter device characterised in that it comprises hands driven independently of each other by stepping motors, a dial, at least a first and a second scale intended to co-operate with at least one of said hands, and manual data input means for introducing, in particular, a number of strokes, said first scale comprising a plurality of positions which correspond respectively to the different holes of a golf course, said device also comprising first selection and display means which can be operated manually to select and display with the aid of a first of said hands in conjunction with said first scale, one of the holes of the course, said device being further characterised in that it also comprises electronic counting, storing, processing and control means for calculating and displaying a number of points on said second scale with the aid of at least one of said hands, said number of points being according to at least a first operating mode of the device, calculated by taking into account said number of strokes introduced for each of the holes selected successively since the beginning of the game.

BRIEF DESCRIPTION OF DRAWINGS

Other characterisitics of the invention will appear more clearly upon reading the following description, given solely by way of example and made with reference to the attached drawings in which.

DETAILED DESCRIPTION OF THE INVENTION

Figure 1:
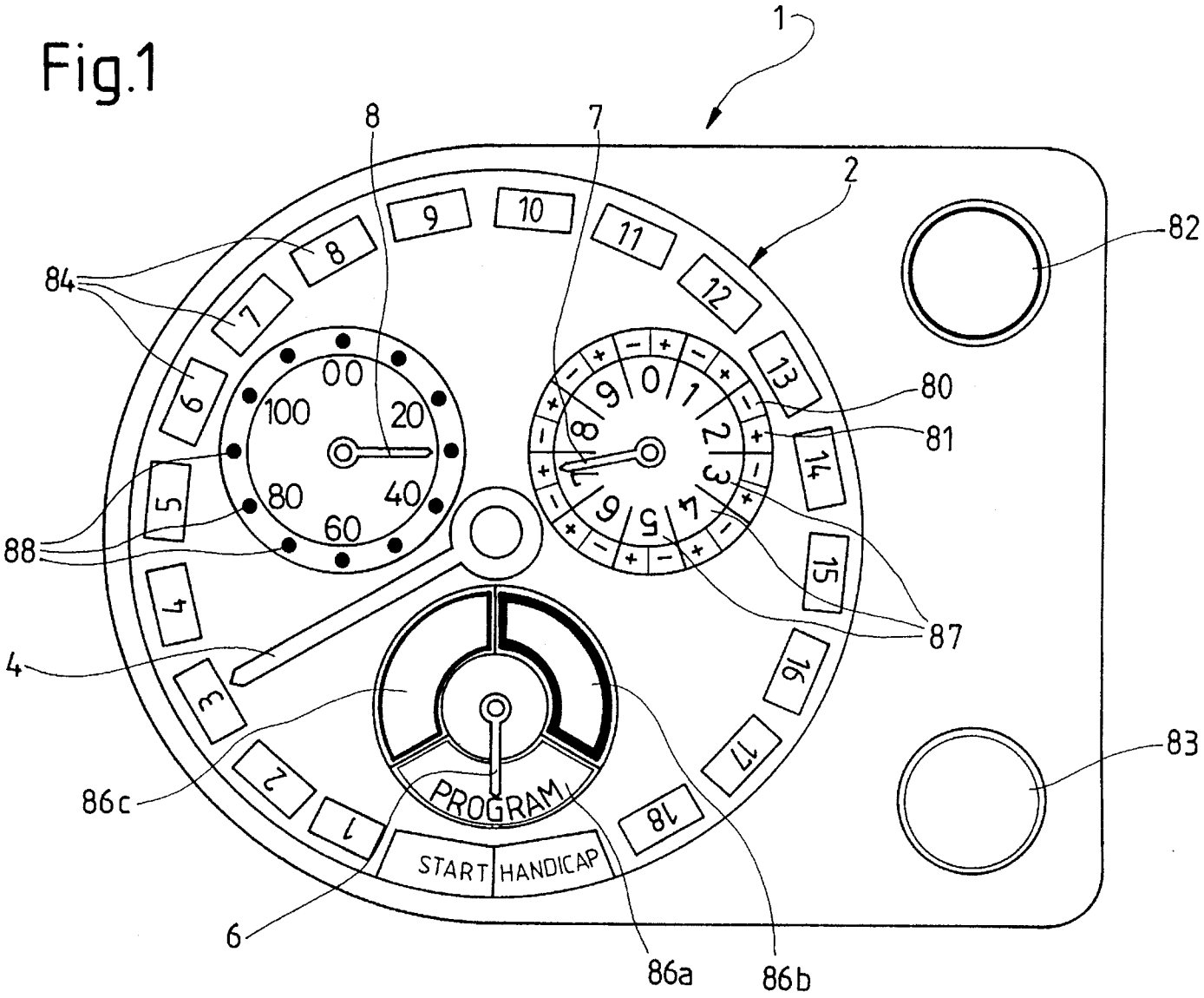
FIG. 1 shows schematically a first embodiment of a device with four hands according to the invention.

In FIG. 1 the assembly of the display means according to the invention are shown by way of example. Said display means comprise four hands driven independently of each other by four stepping motors shown in the following FIGS. These four hands work on four distinct zones of the dial.

Central hand 4 enables the "position" to be displayed and works with the external part of dial 2. This part 84 of tile dial comprises eighteen positions numbered from 1 to 18 corresponding to the eighteen holes of a golf course, plus two positions called "start" and "handicap" corresponding to two complementary functions which will be described below.

The hand at six o'clock 6, enables the "operating mode" to be displayed and works with a graduation 86 comprising three zones referenced respectively 86*a*, 86*b* and 86*c*, corresponding to three distinct operating modes, the "PROGRAM" zone 86*a*, the "simple total" zone 86*b* and the "cumulative total" zone 86*c*.

The hands at two o'clock 7 and at ten o'clock 8 together enable the number of points to be displayed.

Hand 7 works on a graduation of ten positions 87 numbered from 0 to 9 and which correspond to the units. Each of the ten positions comprises a "–" zone 80 and a "–" zone 81 enabling respectively a negative score and a positive score to be displayed. Thus when hand 7 is in the "–" zone, the number of points is negative and conversely when it is in the "+" zone.

Hand 8 works on a graduation 88 numbered from 00 to 110 which is intended to display the tens. Thus, by combining the indications of hands 7 and 8, numbers of points ranging from –119 to +119 can be displayed.

Two push buttons 82 and 83 enable the forward movement of the hands to be controlled and certain parameters to be introduced.

For example, short pushes on push button 82 enable hand 4 to be moved from one position to another. Longer pushes on the same push button 82 enable hand 6 to be moved successively from "PROGRAM" mode 86*a* to "simple total" mode 86*b*, then to "cumulative total" mode 86*c*. It is thus possible for the user, by simple manipulations, to select the "position" and the "operating mode" that he desires.

Push button 83 enables hands 7 and 8 to be acted upon, to increase or decrease the number of points. For example, a short push on push button 83=+1 point and a long push =–1 point. When the counter is in "PROGRAM" mode (hand 6 on "PROGRAM"), the par for the hole indicated by hand 4 can be introduced, that is, in the case shown, the third hole. When hand 6 indicates "simple total" mode 86*b* or "cumulative total" mode 86*c*, the player presses on push button 83 each time that he plays so as to introduce the number of strokes he has played.

Lastly, there are two special positions "START" and "HANDICAP" enabling the player's handicap to be programmed and the final score to be displayed taking account of this handicap.

The following figures give the configuration of the electronic counting, storing, processing and control means which enable the functions described to be achieved.

Figure 2:
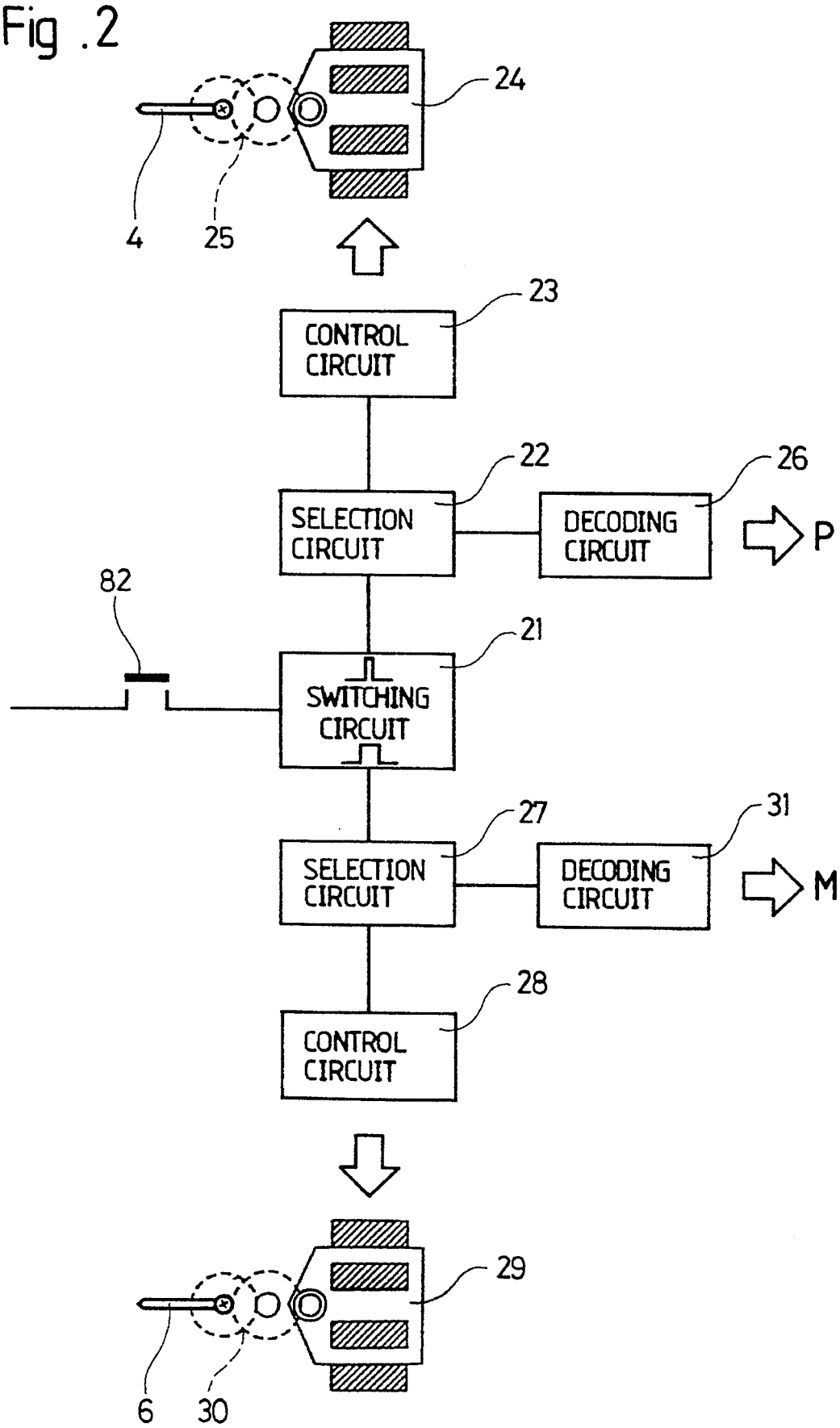
FIG. 2 shows schematically "position" and "operating mode" selection and display means according to the invention.

FIG. 2 shows schematically by way of example the selection and display means according to the invention. One can see push button 82, which controls the forward movement of hands 4 for the "position" display and 6 for the "operating mode" display.

Push button 82 is plugged onto the input of a switching circuit 21 which, when there is a short push on push button 82, sends a control signal to the input of a "position" selection circuit 22, connected to a control circuit 23 of stepping motor 24 which drives hand 4 with the help of gear-wheels 25.

Figure 3:
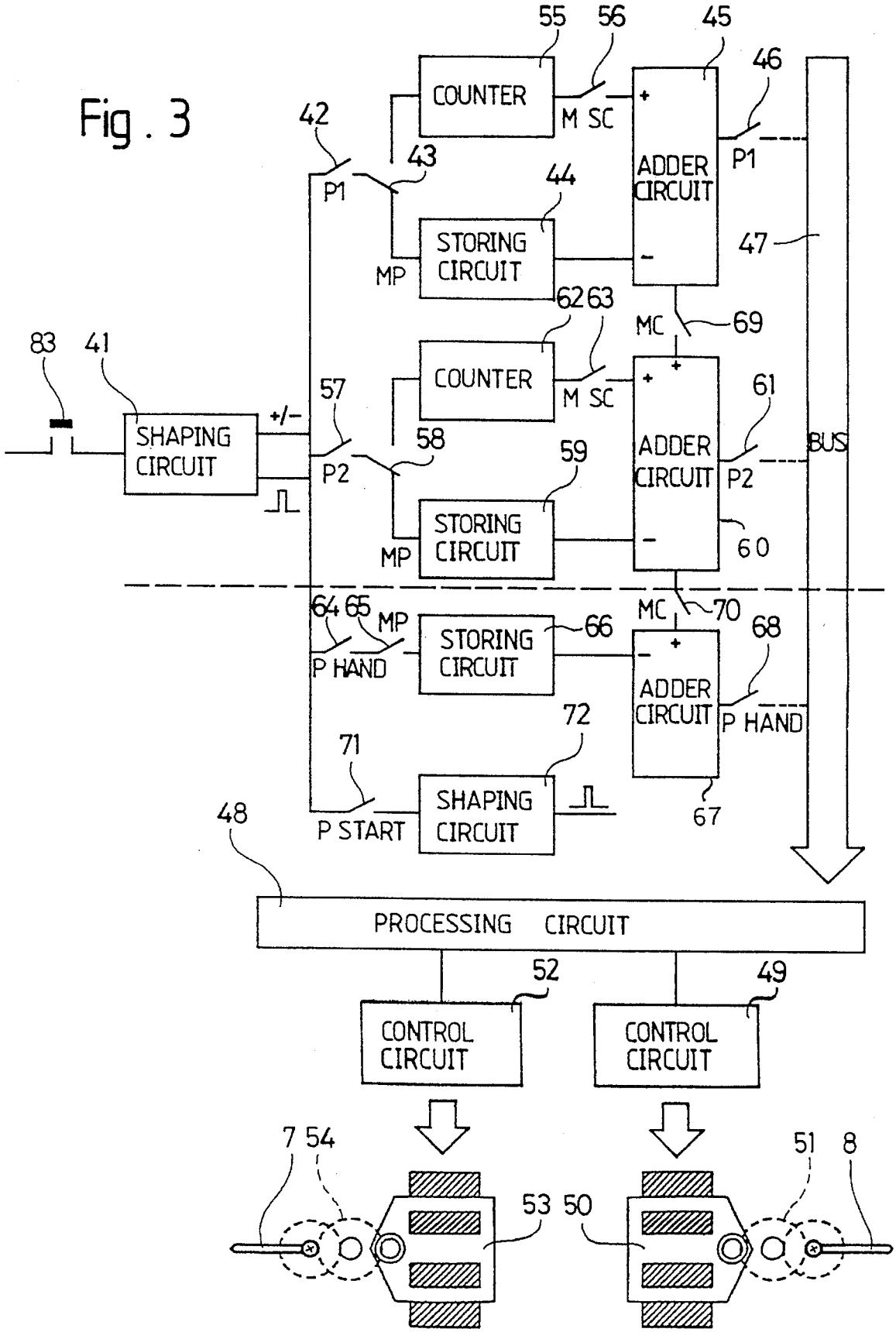
FIG. 3 shows schematically electronic counting, storing, processing and control means according to the invention.

Selection circuit 22 is also connected to a decoding circuit 26 sending signals to the electronic counting, storing, processing and control means of FIG. 3 as a function of the "position" selected.

When there is a long push on push button 82, switching circuit 21 sends a control signal to the input of an "operating mode" selection circuit 27, connected to a control circuit 28 of stepping motor 29 which drives hand 6 with the help of gear-wheels 30. Selection circuit 27 is also connected to a decoding circuit 31 sending signals M to the electronic counting, storing, processing and control means of FIG. 3 as a function of the "operating mode" selected. It should be noted that, in a simplified configuration, one could have only one "operating mode". In such case, the "operating mode" selector can be omitted.

It is known that the functions of an electronic system can be formed in numerous ways, especially if account is taken of the almost unlimited possibilities of programmed logic and the microprocessers currently available on the market. This is why the description is limited to general functions, the detailed conception being within the reach of any man skilled in the art.

Referring to FIG. 1, it can be seen that scale 84 comprises twenty "positions" corresponding to holes 1 to 18, plus the "handicap" position and the "start" position. The "position" selection circuit may thus be a simple counter-by-twenty which is increased by one step at each short push on push button 82. For each of these "positions" there is a corresponding number of steps which hand 4 must take from the original position to come to face the "position" concerned. For example, if hand 4 takes 60 steps per hour circle and the original position is at 12 o'clock, the "start" position corresponds to 32 steps, the "10" position to 1 step, etc . . . There is thus for each "position" given by the selection counter-by-20, a number between 0 and 59 which may be reconstituted by a simple algorithm via a correspondence table set in the ROM of a microprocessor for example.

This number is transmitted to control circuit 23 of the stepping motor, which calculates the number of steps which separate the previously selected position from the new one, and delivers to stepping motor 24 the number of pulses necessary to drive hand 4 into the newly selected position. This configuration enables hand 4 to be positioned with precision, whatever the number of steps which separate the different "positions".

Thus, referring to FIG. 1, one can see that there are only three distinct "operating modes". For hand 6 making 60 steps per hour circle, there is "program" mode 86*a* which is at 30 steps from the original position, "simple total" mode 86*b*, which is at 50 steps from the original position and "cumulative total" mode 86*c* which is at 10 steps from the original position. "Operating mode" selection counter 27 thus has three distinct states corresponding to the 10, 30 and 50 numbers of steps, which determine the number of pulses which control circuit 28 will transmit to motor 29 to drive hand 6 into the desired position.

It should be noted that the "operating mode" selection and display means could perfectly easily be electromechanical, of the three position selector switch type.

FIG. 3 shows by way of example the electronic counting, storing, processing and control means for displaying the number of points.

One can see again hands 7 and 8 and push button 83 of FIG. 1. Push button 83 is connected to a formation circuit 41 which sends on the one hand the counting pulses, and on the other hand a signal for the counting sign, "+" for short pushes and "–" for long pushes. The outputs of formation circuit 41 are connected to the entries of several electronic switches.

All the electronic switches and selector switches shown in FIG. 3 are controlled by position signals P and mode signals M sent by the electronic circuit of FIG. 2.

Thus when hand 4 (FIG. 1) is in "position 1" and hand 6 indicates the "PROGRAM mode" 86*a*, switch 42 is closed and selector switch 43 sends the counting pulses to the input of a counting and storing circuit 44 which records the par for the first hole. This counting circuit may have only a few positions, for example 4, corresponding to 0,3,4 and 5 strokes respectively, which corresponds to standard golf courses, position 0 signifying that one wishes to display the total number of strokes without taking account of any programming. Circuit 44 is connected to the input "–" of an adder circuit 45 whose output is connected to switch 46 which like switch 42 is only closed when "position 1" is set. The output of adder 45 is thus connected to a bus 47 which sends the data to be displayed to a processing circuit 48 which will separate the units from the sign and from the tens. In the case presently described, the data corresponds to the value contained in circuit 44, that is the number of strokes programmed for the first hole, with the sign "–".

The units with the sign are sent to a control circuit 49 which enables a precise position on the dial to correspond to each value between –9 and +9 which is provided to it, and which controls the forward movement of stepping motor "50" to drive, with the help of gear-wheels "51", hand 7 to face said dial position.

The tens are sent to a control circuit 52 which enables a precise position on the dial to correspond to each ten value between 00 and 110 which is provided to it, and which controls the forward movement of stepping motor 53 to drive, with the help of gear-wheels 54, hand 8 to face said dial position.

When one leaves "PROGRAM mode" 86*a*, selector switch 43 is thrown and the counting pulses are sent to stroke counter 55 connected by switch 56, which is closed in "simple" and "cumulative" modes to the input "+" of adder 45. The value of the data which passes over bus 47 is thus equal to the contents of counter 55 less the programmed value contained in circuit 44.

When hand 4 (FIG. 1) moves to "position 2", switches 42 and 46 open, whilst switch 57 closes. The configuration is the same as the previous one and in particular in "PROGRAM mode" selector switch 58 is connected to circuit 59 for counting and storing the number of strokes programmed for the second hole whose ouput is itself connected to the input of adder circuit 60 which is in turn connected by switch 61 to bus 47 which then transmits the data concerning the second hole to processing circuit 48. In the other "modes", the counting pulses go to counter 62 which is connected by switch 63 to the input "+" of adder 60.

The same applies to the third to eighteenth holes which are not shown.

Two special positions remain, namely HAND corresponding to the HANDICAP part of the dial in FIG. 1 and START.

When the "HAND position" is set, switch 64 is closed. If the "PROGRAM mode" is set, switch 65 is also closed and the counting pulses go to the input of counting and storing circuit 66 which records the player's handicap. Counter 66 is connected to the input "–" of adder 67 whose output goes, via switch 68 to bus 47, thus enabling the contents of counter 66 to be displayed.

The difference between "simple total" mode 86*b* and "cumulative total" mode 86*c* remains to be established. This is achieved simply by means of switches 69 and 70 which enable the outputs of adders 45, 60, 67 etc. to be connected to an input "+" of the following adder, so as to obtain a cumulative total of the values. In "simple total" mode, switches 69 and 70 are open and there is no cumulative total. In "cumulative total" mode, these switches are closed and there is a cumulative total.

Finally, when the "START position" is set, it is switch 71 which is closed, the pulses originating from push button 83 go the input of decoding circuit 72, which generates reset pulses in response to particular manipulations of said push button 83. These reset pulses are used to reset all stroke counters (55,62,66 . . . ) to 0 and to start a new round.

Figure 4:
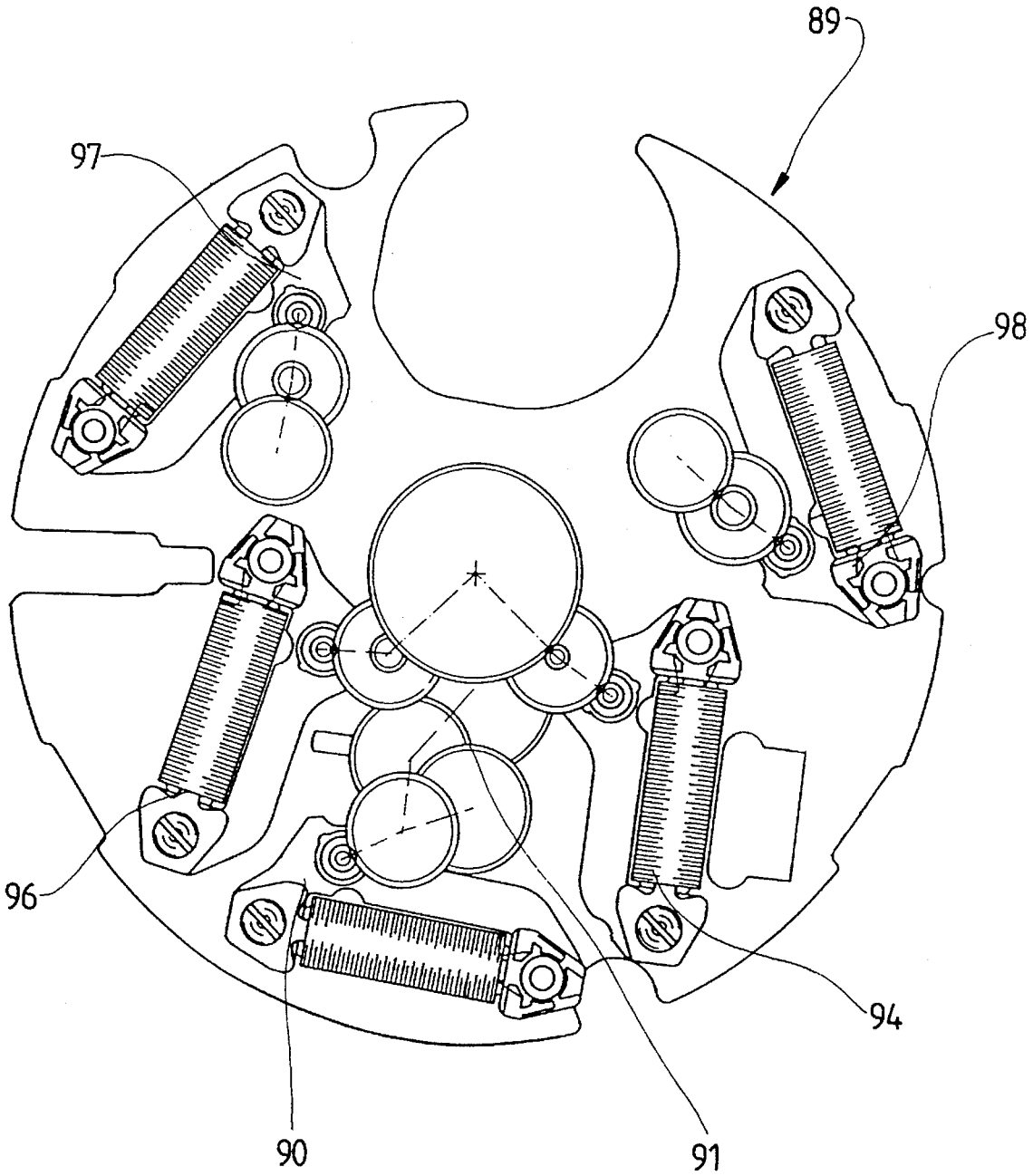
FIG. 4 shows in a very schematic way a known watch movement able to be used to form a golf counter according to the present invention.
Figure 5:
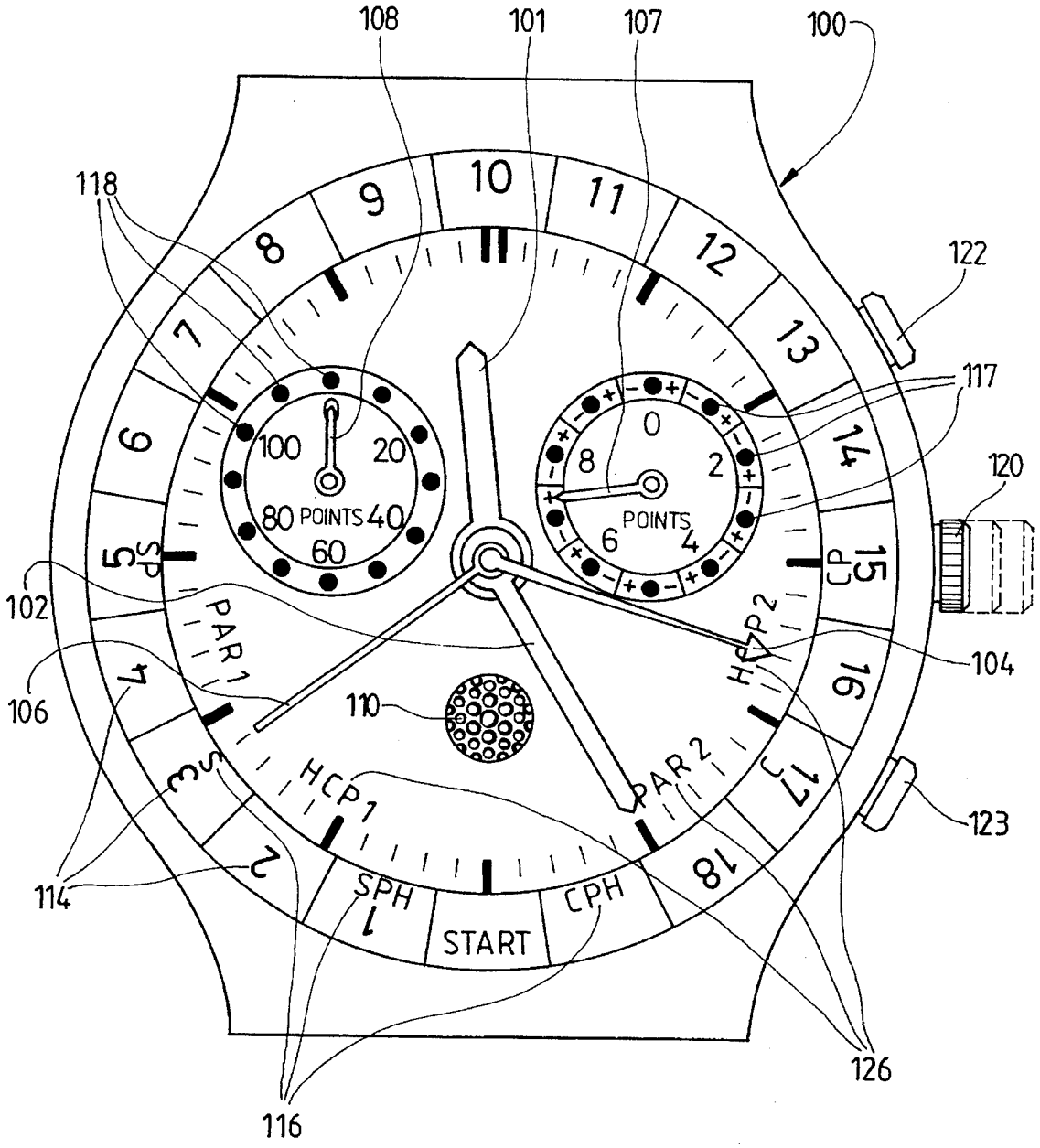
FIG. 5 shows a first example of a golf counter according to the invention formed using the watch movement of FIG 4.

FIGS. 4 and 5 show a second embodiment of a golf counter according to the invention incorporated into a wristwatch. In the present example, the golf counter according to the invention uses as display means the chronograph watch movement indicating organs of a commercially available model. The watch movement used is in this case the calibre 251.262 of the manufacturer ETA® registered in Granges, Switzerland.

As calibre ETA 251.262 is a known model, it will be described here only in a very succinct manner. This calibre comprises five stepping motors each operating at least one hand, and an electronic control module capable of controlling the five motors independently of each other. FIG. 4 shows schematically the arrangement of the motors and the gear-wheels for the different indicating organs in the case of movement 89. The movement comprises, as stated above, five stepping motors referenced respectively 90, 94, 96, 97 and 98 each operating a gear train connected to at least one hand (not shown in FIG. 4). A first motor 90 is provided for operating, by gear-wheels (shown partially in FIG. 4 and referenced by the numerical reference 91), three hands indicating respectively the hours, minutes and seconds to provide a permanent indication of the actual time. One peculiarity of movement 251.262 lies in the fact that, as is the case with other chronographs, the axis of the second hand is off centre at six o'clock whereas the cannon-pinion and the hour-wheel are placed at the centre of the movement.

The four other stepping motors 94, 96, 97 and 98 which each operate a single hand are not used for the standard time display and are thus available with their respective gear trains and hands to form the display means for the golf counter.

Before moving on to the description of the actual golf counter, it should also be noted that ETA movement 251.262 comprises three external control organs. These consist of a control stem and two push buttons (referenced respectively 120, 122 and 123 in FIG. 5). The control stem is a stem which may have three positions which are respectively a pushed in position, a first pulled out position and a second pulled out position. The axial displacement of stem 120 between these different positions acts upon a flexible contact strip (not shown) placed inside the case so that in the first pulled out position of stem 120, said strip is held in contact with a first metallic terminal (not shown), so that in the second pulled out position of stem 120, it is held in contact with a second metallic terminal (not shown), and so that in the pushed in position of stem 120, it is suspended mid-way between the two metallic terminals. The effect of the electrical contact between %he flexible strip and the first or second terminal is to earth respectively a first or second path of the printed circuit which carries the electronic movement module. Similarly, when the first or second push buttons 122, 123 are activated, a third or a fourth path of the printed circuit is respectively earthed.

One can see in FIG. 5 the dial as well as the golf counter hands—wristwatch 100 formed from the watch movement which has just been described. FIG. 5 also shows hour hand 101 and minute hand 102 which are arranged in the centre in the conventional manner. As for the second hand, which as already stated is intended to be arranged on a off centre axis at six o'clock, this has been omitted. The axis provided to carry this little second hand is used to carry a wheel 110 which in this particular example has the form of a golf ball whose function is essentially decorative.

The functions fulfilled by the four other hands 104, 106, 107 and 108 visible in FIG. 5 are pretty much the same as those fulfilled by the hands of the golf counter in FIG. 1. However, whereas the golf counter in FIG. 1 comprises two external control organs formed by push buttons 82 and 83, the watch movement used in the present example comprises as already stated three control organs which are in this case two push buttons 122, 123 and a stem 120 able to be brought into two pulled out positions.

In the present example, the different positions of the stem are used as follows: one of the two pulled out positions, the second in this case, is used in the conventional manner for resetting the time of the watch, and the first pulled out position is used for the golf counter. By bringing stem 120 from the pushed in position to the first pulled out position or vice versa, the user switches the golf counter between a first and second operating mode. The two operating modes of the golf counter are according to the present example a first mode which is active when the stem is pushed in and which will be called hereafter the "game" mode and a second mode which is active when the stem is in its first pulled out position and which will be called hereafter the "programming" mode. It is essentially due to the existence of these two particular operating modes that the invention differs from that shown in FIG. 1. A man skilled in the art will however understand that it would also be possible to achieve a golf counter operating in an identical manner to that shown in FIG. 1 with the aid of the watch calibre used here.

The functions fulfilled by the different hands in the embodiment described here differ only slightly from those of the golf counter hands of FIG. 1.

"Chronograph hand" 104 in particular is used here to display the "position", as is done by central hand 4 of the FIG. 1 counter. The display of the "position" is achieved in the present example in relation to inscriptions 114 provided in the surface of the watch bezel. This bezel comprises eighteen positions numbered from 1 to 18 corresponding to the eighteen holes of a golf course, plus a "START" position which enables the electronic module to be reinitialised before the beginning of a round. It should also be noted that the as chronograph hand motor in this movement is intended to effect sixty steps per turn of the dial, the motor has to effect three steps to pass from one hole to the next.

Hands 107 and 108 which are visible in FIG. 5 and which are off centre respectively at two o'clock and ten o'clock enable the number of points and the sign "+" or "–" be displayed in a similar manner to that described in relation to FIG. 1.

The second centre hand 106 formed by the "counter hand" of the chronograph movement enables, in the "game" mode, namely in the pushed in position of the control stem, the calculating mode used to determine the number of points to be indicated by the two hands 107 and 108 to be selected or indicated. These different point calculating modes are indicated by the concentric inscriptions provided on the bezel inside the numbered positions corresponding to the holes. The inscriptions are as follows:

S indicates the "simple total" point calculating mode without subtracting the par or the handicap.

SP indicates the "simple total" point calculating mode subtracting the par but without subtracting the handicap.

SPH indicates the "simple total" point calculating mode subtracting both the par and the handicap.

The inscriptions C, CP and CPH correspond to the same catetgories but for the "cumulative total" point calculating mode.

In programming mode, that is to say in the first pulled out position of the control stem, the second hand in the centre 106 is used to select parameters for programing, whereas the first hand in the centre 104 is used as before to determine the golf course hole concerned.

The selection of the programming parameters by hand 106 is achieved by means of a certain number of inscriptions arranged at the periphery of the dial. These inscriptions are #our in number and are as follows:

HCB1 indicates the position corresponding to the programming of the handicap for a first course.

HCB2 indicates the position corresponding to the programing of a handicap for a second course.

PAR1 indicates the position corresponding to the programing of the par for a first given course.

PAR2 indicates the position corresponding to the programing of the par for a second course.

The method of programming the golf counter typically takes place as follows:

The user pulls the crown to bring stem 120 into the first pulled out position then moves second centre hand 106 to face inscription PAR1 or inscription PAR2 to select the programming of the respective par for a first or second course. The displacement of hand 106 is controlled by the user by a long push (at least one second in this example) on second push button 123. At each long push on second push button 123, second centre hand 106 moves in a clockwise direction until it reaches the next inscription on the dial. Once the programming parameter, for example PAR1, has been selected, the user moves first centre hand 104 to face the number 1 inscribed on the bezel, thus selecting the first hole of the course. The displacement of hand 104 is controlled by short pushes on the same push button 123. Each short push moves hand 104 from one indication to the next, the a clockwise direction. Once hand 104 has stopped facing hole number 1, the user may program the par for the first hole of the course. He achieves this programming by pressing briefly on second push button 122 a number of times equal to the par to be programmed. The number of pushes on first push button 122 is simultaneously displayed by hands 107 and 108. In the event of an error during the introduction of the number of strokes, it is possible to subtract one or more strokes from the total which has just been programmed by exercising a corresponding number of long pushes (for example at least one second) on first push button 122.

Once the par for the first set of strokes has been programmed, the users moves on to programming the second set of strokes by a short push on second push button 123 to move first centre hand 104 to face the second hole.

Position PAR2 enables the par for a second course to be programmed. Thanks to this particular feature, the golf counter enables the par for two different golf courses to be simultaneously memorised.

It should be noted that in game mode, namely in the pushed in position of the control stem, the two pushers function in an identical manner to that which has just been described. In particular, the first push button controls the two hands 107 and 108, a short push increasing the stroke counter by one unit and a long push decreasing the counter by one unit. First centre hand 104 and second centre hand 106 are controlled by second push button 123, a short push operating hand 104 and a long push hand 106.

Figure 6:
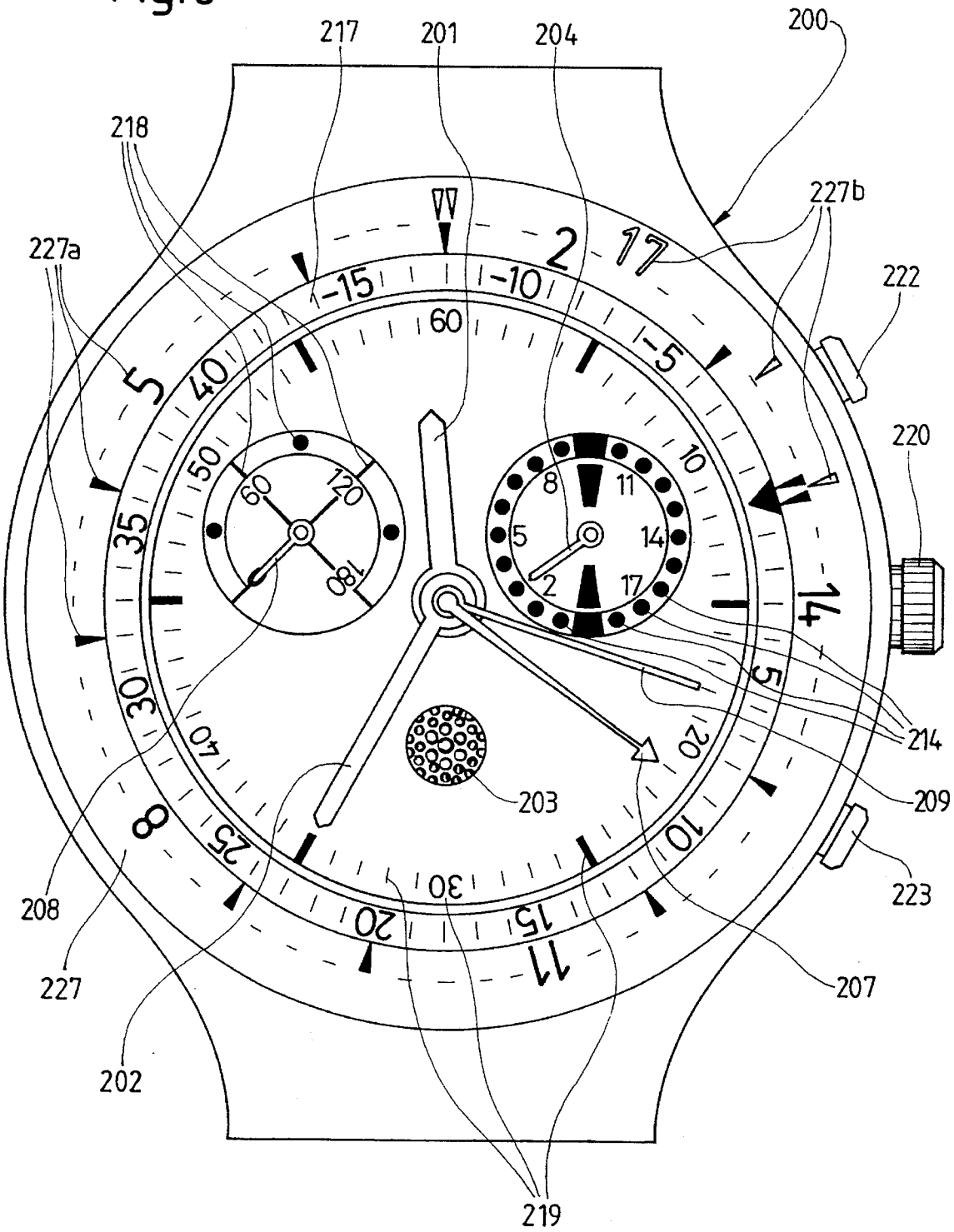
FIG. 6 shows a second example of a golf counter according to the invention formed using the watch movement Of FIG. 4.

FIG. 6 illustrates another embodiment of the golf counter according to the invention. This embodiment is like the previous one, conceived from ETA movement 251.262. In conformity with the more detailed description which will be given below, the two most important features of the embodiment shown in FIG. 6 are respectively, on the one hand, not requiring an electronic programming circuit to take into account the par or the player's handicap, and on the other hand, the simultaneous display of the number of points according to the simple total mode and the cumulative total mode.

The counter of FIG. 6 comprises four hands in the centre. These consist of an hour hand and a minute hand respectively referenced 201 and 202 and two hands 207 and 209 both provided to co-operate with a scale 219 situated on the periphery of the dial and defining an hour circle of sixty graduations. Around the dial is placed a rotating bezel carrying a scale 217 defining a second concentric hour circle of sixty graduations. The graduations of this second scale are numbered from –15 to 45, and the rotating bezel is also provided to receive a detachable ring 227. This detachable ring has on its upper face two concentric index rows respectively referenced **227*a* and 227*b* designating particular positions on scale 217** of the bezel to take into account the par and possibly also the player's handicap.

The golf counter of FIG. 6 also comprises a hand 204 placed at two o'clock and used with a scale 214 comprising eighteen positions corresponding to the eighteen holes of a golf course. The counter also comprises a hand 208 placed at ten o'clock and used with a scale 218 graduated in a scale of thirty points and enabling a number of points up to a maximum of one hundred and eighty to be indicated.

One can also see in FIG. 6 control stem 220 and the two push buttons 222, 223 of calibre 251.262. In the present embodiment, the control stem is used only to set the time of the watch and for reinitialising the golf counter. The second pulled out position of the calibre 251,262 control stem fulfils in the present embodiment the function of resetting the counter to zero fulfilled by the "START" position in the embodiments previously described. The two push buttons 222, 223 maintain the function which they had in the other embodiments.

The present embodiment enables, by a different distribution of the display functions fulfilled by the different hands, the number of points corresponding to the simple total and that corresponding to the cumulative total to be displayed simultaneously. As already stated, in the present embodiment, the holes of the course from 1 to 18, are displayed at two o'clock, whereas the points are displayed by one of central hands 207 on scale 219. As this scale comprises only sixty positions, the display at ten o'clock indicates the sixties which gives a total counting capacity of one hundred and eighty points. Second central hand 209 remains available to indicate for example the number of points at the previous hole. The relative position of the two central hands 207 and 209 thus indicates the number of strokes played at the last hole.

The points are displayed in absolute value, but the fact of displaying them by one of central hands 207, 209 on scale 219 enables a particular combination enabling the simultaneous reading of the points in relation to the par.

To this end, the watch comprises a rotating bezel similar to that found on diving watches, comprising a graduation 217 of sixty positions from −15 to +45. This rotating bezel is positioned as a function of the par of the various holes. Thus, at the beginning, the 0 of the bezel is positioned at midday. When the player arrives at the first hole, he moves the bezel forward by a number of seeps corresponding to the par of the first hole. The player may then read directly on the graduation of the bezel a number of points which takes account of the par. When the player arrives at the second hole, he moves the bezel forward by a number of steps corresponding to the par of the second hole, and so on for the following holes.

In FIG. 6, the player is at the third hole and he has moved his bezel forward by four steps at the first hole (PAR 4) by five steps at the second hole (PAR 5) and by three steps at the third hole (PAR 3), which amounts to a total of twelve steps. The player has actually twenty one points in total. Reading the bezel graduation he reads nine points, which represents 21−12=9, that is his result in relation to the par. If he had only scored 12 points, he would be at 0, and if he had only scored 6 points, he would be at −6.

Further, the two central hands 207, 209 are spearated by four graduations, which means that the player has already played four strokes at the third hole (simple total equals four).

With this combination of rotating bezel and second central hand 209 indicating the total points at the preceding hole, the player may thus obtain his result directly in relation to the par and the number of strokes played at the hole. The only disadvantage arises from the fact that he may make a mistake in moving the bezel, and that he has no simple means of checking during the round.

A second original combination enables this disadvantage to be avoided. To this end, the watch comprises a detachable ring 227 comprising indices whose positioning corresponds to a particular course, these indices being numbered from 1 to 18 and corresponding to the eighteen holes of the course. The number of steps separating each index on the graduation coresponds to the par for each hole of a pre-determined course. When the total sum of the par for all the holes of a given course goes beyond sixty, the indices are distributed on two concentric rows 227*a* and 227*b*. These indices could of course also be arranged on a single row in the form of a spiral on the detachable ring. As all the courses are in theory different, as many detachable rings are required as there are different courses. However, a player only uses a limited number of courses so that one or two rings will be sufficient.

Referring to FIG. 6, one can see that the player has only to position at midday the index corresponding to the hole which he is playing. Thus, for example, the player is at the third hole, and has positioned index 3 of the detachable ring at midday. Thus, he can read directly his result in relation to the par on the graduation of the bezel. It should be made clear that the detachable ring is rotationally attached to the rotating bezel, and that the points 0 of the bezel and the detachable ring are combined. To this end, the detachable ring may comprise pins or be fixed onto the rotating bezel by simple magnets. Many other means of fixing are possible.

It should be noted finally that the graduation of the detachable ring may take account not only of the peculiar characteristics of a particular course, but also of the handicap of a particular player. The number of steps separating each hole on the graduation of the detachable ring thus corresponds to the par increased by the player's handicap, apportioned as a function of the difficulty of each hole. Thus, each player may have custom made one or more personalised detachable rings as a function of the course or courses which he frequents and his handicap.

U.S. Pat. No. 4,058,969 describes an electronic analogue watch whose second hand moves at the rhythm of one step per second in normal operating mode, and which may when certain predetermined conditions are fulfilled, operate according to an abnormal mode where the second hand jumps four steps once every four seconds.

By integrating this possibility into the electronic module of calibre 251.262, it would be possible to cause mobile 203, in the form of a golf ball (FIG. 6), to move forward, in normal conditions, every second by a step corresponding to one sixtieth of a turn, and when the stroke counter has just been increased, to make the golf ball jump forward every four seconds, during a predetermined period of time, before reverting to its normal progression rhythm.

This possibility enables the player to have indicated to him in an easily visible way whether or not he has correctly counted his last stroke in the golf counter.

I claim:

1. Golf counter device for displaying on dial data relating to game of golf on a plurality of scales, in particular a number of points when a particular hole of a golf course is played, said device comprising:

manual imputting means for introducing in particular a number of strokes, selection means and display means manually activated when said particular hole is played, said inputting, selection and display means cooperating with electronic counting, storing, processing and control means to calculate and display both the number of strokes played on the particular hole (simple total), and the total number of strokes introduced for each of the successively selected holes since the beginning of the game (cumulative total), said device being characterised in that the display means are provided with at least two hands arranged to move above a dial with their axes passing substantially through the center of said dial and being driven independently of each by stepping motors controlled by said electronic counting, storing, and processing means so as to cooperate with the plurality of scales, one of said hands displaying the cumulative total and the zero point of the other hand displaying the simple total.

2. Device according to claim 1 characterised in that once the number of strokes has been increased, a mobile organ visible on the dial changes its displacement mode during a predetermined period of time to indicate to the player that he has just introduced a stroke.

3. Device according to claim 1 characterised in that at least one of said scales comprises a negative sector.

4. Device according to claim 1 characterised in that said second scale is carried by a rotating bezel, so as to enable the zero of said second scale to be staggered as desired so that said number of points displayed takes into account the model number of strokes for the course.

5. Device according to claim 4, characterised in that said rotating bezel comprises a detachable ring carrying indications relating to a particular course.

6. Device according to claim 5, characterised in that said detachable ring carries indications relating to a particular player.

7. Analogue display watch characterised in that it is combined with a golf counter device according to claim 1.

8. Analogue watch according to claim 7, characterised in that it comprises a time setting crown able to be moved axially between a neutral position and at least two active positions, and in that a first of said active positions enables the time to be set, whilst a second of said active positions enables a model number of strokes (or "PAR") to be introduced and stored for each hole of a course.

9. Device according to claim 1, characterised in that at least one of said scales comprises a negative sector.

10. Device according to claim 2, characterised it that at least one of said scales comprises a negative sector.

11. Device according to claim 2, characterised in that said second scale is carried by a rotating bezel, so as to enable the zero of said second scale to be staggered as desired so that said number of points displayed takes into account the model number of strokes for the course.

12. Device according to claim 3, characterised in that said second scale is carried by a rotating bezel, so as to enable the zero of said second scale to be staggered as desired so that said number of points displayed takes into account the model number of strokes for course.

13. Analogue display watch characterised in that it is combined with a golf counter device according to claim 6.

14. Device according to claim 12, characterised in that said rotating bezel comprises a detachable ring carrying indications relating to a particular course.

15. Devices according to claim 1, characterized in that the display means of a particular hole also comprises an additional hand arranged to move above said dial in front of another scale provided with a plurality of positions corresponding to each hole of the golf course.

* * * * *